US007107692B2

(12) United States Patent
Kappes et al.

(10) Patent No.: US 7,107,692 B2
(45) Date of Patent: Sep. 19, 2006

(54) CLEANING DEVICE FOR A SHAVING APPARATUS

(75) Inventors: Diana Kappes, Eppstein (DE); Andreas Larscheid, Kelkheim (DE); Uwe Ludascher, Kriftel (DE)

(73) Assignee: Braun GmbH, Krongberg (DE)

( * ) Notice: Subject to any disclaimer, the term of this patent is extended or adjusted under 35 U.S.C. 154(b) by 217 days.

(21) Appl. No.: 10/815,322

(22) Filed: Apr. 1, 2004

(65) Prior Publication Data

US 2004/0194326 A1 Oct. 7, 2004

(30) Foreign Application Priority Data

Apr. 4, 2003 (DE) ..... 103 15 450

(51) Int. Cl.
*B26B 21/40* (2006.01)
*B08B 3/04* (2006.01)

(52) U.S. Cl. ..... 30/538; 30/537; 15/104.92; 134/92

(58) Field of Classification Search ..... 30/537, 30/538, 41, 41.5; 132/292; 134/92; 15/104.92; 206/208

See application file for complete search history.

(56) References Cited

U.S. PATENT DOCUMENTS 3,172,416 A * 3/1965 Simmons ..... 134/111
4,838,949 A * 6/1989 Dugrot ..... 134/32
5,649,556 A * 7/1997 Braun ..... 134/92
5,711,328 A 1/1998 Braun ..... 134/111
6,131,230 A * 10/2000 Manabat ..... 15/104.92
6,226,870 B1 * 5/2001 Barish ..... 30/43.6
6,263,890 B1 7/2001 Hoser ..... 134/111
2005/0034313 A1 * 2/2005 Hoser et al. ..... 30/457
2005/0045204 A1 * 3/2005 Hoser et al. ..... 134/13

FOREIGN PATENT DOCUMENTS

DE 44 02 238 9/1996
DE 197 05 977 3/1998
EP 0 743 883 B1 * 6/1999

* cited by examiner

*Primary Examiner*—Hwei-Siu Payer
(74) *Attorney, Agent, or Firm*—Fish & Richardson P.C.

(57) ABSTRACT

A cleaning device for a shaving apparatus includes a chassis supporting a cleaning container for receiving the shaving head region of the shaving apparatus. A detent device is movably suspended on the chassis and is biased by means of a resilient element toward a first end position in which the detent device fixedly secures a replaceable reservoir holding a supply of cleaning liquid to the chassis in a positive engagement relationship therewith.

24 Claims, 4 Drawing Sheets

CLEANING DEVICE FOR A SHAVING APPARATUS

RELATED APPLICATIONS

This application claims priority to German Patent Application No. DE 103 15 450.7, filed Apr. 4, 2003, which is incorporated herein by reference in its entirety.

TECHNICAL FIELD

This invention relates to a cleaning device, for a shaving apparatus, having a replaceable reservoir for holding a supply of cleaning liquid.

BACKGROUND

Cleaning devices for shaving apparatus serve to remove hair and other particles adhering to the region of the shaving head. Cleaning devices of this type are known in a variety of functions and designs, which are operated both manually and electrically.

EP 0 743 883 B1 discloses is a manually operated cleaning device for flushing objects such as a shaving unit of a rotary dry shaver. The cleaning device includes two containers for a flushing liquid. One of the containers has a variable volume, enabling the flushing liquid to be pumped between the containers by variation of the volume with the liquid current being used for flushing the shaving unit disposed in a receptacle between the containers. To retain contaminants, provision is made for a filter through which the liquid current is forced in a direction of flow predetermined by a valve arrangement.

U.S. Pat. No. 3,172,416 discloses a cleaning device for an electric razor which has a casing with an opening for receiving the cutter portion of the razor. The casing accommodates a motor-driven impelling assembly for generating a circulating current of a cleaning liquid, and an assembly for collecting hair and other particles. For cleaning, cleaning liquid is caused to flow through the cutter portion while the razor connected to the cleaning device is set in operation.

DE 44 02 238 C2 discloses a cleaning device for the shaving head of a dry shaver. The cleaning device includes a receptacle for the shaving head of the shaving apparatus and at least one cleaning liquid container. The receptacle is disposed above the liquid level of the cleaning liquid and is adapted to be supplied with cleaning liquid from the cleaning liquid container by means of a motor-driven conveying device. The receptacle is connected with the cleaning liquid container through an overflow device and/or at least one outlet opening.

DE 690 21 898 T2 discloses a dry shaving apparatus having a drivable cutter element and a vibratory device adapted to be driven separately to clean a shaving head of the shaving apparatus without an external cleaning device. The vibratory device serves to dislodge hair particles and other contaminants adhering to the cutter element or other parts of the shaving apparatus. The vibratory device is set in operation by reversing the direction of rotation of the shaver's electric motor from the direction of rotation used during the shaving mode. With the direction of rotation thus reversed, a claw coupling driving the cutter element in the presence of a normal direction of rotation operates to produce a vibrating motion. To reverse the direction of rotation, a reversing switch is provided on the shaving apparatus. It is also possible for the electric motor to be set in operation in the reverse direction of rotation automatically for a short period of time after the shaving apparatus is turned off.

It is an object of the present invention to provide a cleaning device for a shaving apparatus in such manner as to be economically manufacturable, to afford ease of handling when replacing the cleaning liquid, and to produce very good cleaning results.

The present invention can provide good cleaning results with improvements in the technical implementation of assembly and demounting of a replaceable cleaning fluid reservoir.

SUMMARY

According to one aspect of the invention, a cleaning device for a shaving apparatus includes a chassis supporting a cleaning reservoir for receiving the shaving head portion of the shaving apparatus. It also includes a detent device that is movably suspended on the chassis. A resilient element biases the detent device toward a first end position in which the detent device fixedly secures a replaceable reservoir to the chassis in a positive-engagement relationship therewith. The replaceable reservoir can hold a supply of cleaning liquid.

The present invention can afford the advantage of providing a cleaning device with relatively little effort, in which the reservoir holding the cleaning liquid can be replaced very simply and speedily. The positive-engagement attachment of the reservoir provides a reliable hold on the reservoir.

With the detent device, the reservoir can be fixedly secured by positive engagement, particularly in a mounting direction provided for reservoir replacement. Furthermore, the securing of the reservoir by positive engagement in a direction transverse to the mounting direction of the reservoir can be accomplished with the chassis or with components fixedly connected with the chassis. This makes it possible for the detent device to be of straightforward construction and to function reliably.

In one embodiment of the cleaning device, the detent device is suspended on the chassis so as to be movable in a direction transverse to the mounting direction of the reservoir. This has the advantage of requiring only relatively low forces for locking and unlocking the reservoir while providing a locking mechanism capable of withstanding very high loads. Advantageously, provision is made for a release element for moving the detent device, by overcoming the restoring force of the resilient element, in the direction of a second end position in which the detent device releases the reservoir. The release element can be movable in particular in a direction transverse to the direction of movement of the detent device. The release element enables the reservoir to be released in particularly simple manner.

In a further embodiment of the cleaning device, the detent device is rotatably suspended on the chassis.

Particularly advantageously, the detent device makes positive engagement with the reservoir in the region of the reservoir bottom. In this particular region of the reservoir, suitable engagement provisions can be implemented with very little effort. Preferably, the detent device is configured as a housing part encompassing the reservoir. This dual function is advantageous in the sense of reducing required effort. In addition, the attendant accessibility of the detent element affords handling advantages when replacing the reservoir.

The outlay for the cleaning device can be further reduced and a particularly compact construction can be achieve by having the chassis supported by the reservoir. Thus, the reservoir serves as substitute for an otherwise necessary supporting structure. Preferably, the reservoir is characterized in that provision is made for at least one recess for positive engagement with a detent device of the cleaning device. The recess can be formed in particular in the bottom region of the reservoir.

Another aspect of the present invention features the combination of a shaving apparatus and the above-described cleaning device. The shaving apparatus can include an actuating device for activating a cleaning function that sets the shaving apparatus in operation temporarily during cleaning. This has the advantage of enabling the shaving apparatus to be equipped with a cleaning program optimally suited for its construction and dispensing with the outlay involved in implementing the cleaning program for the cleaning device. The actuating device may be of the manually operable type. The actuating device may also be operable by the cleaning device.

Another aspect of the present invention features a method of replacing a reservoir holding a supply of cleaning liquid for a cleaning device used for cleaning a shaving apparatus. The method includes approaching the cleaning device and the reservoir to one another for mounting the reservoir. The procedure is such that in the course of the approaching movement, a detent device of the cleaning device is displaced or rotated, and the detent device springs back when a mounting position provided for the reservoir is reached, thus locking the reservoir with the cleaning device by positive engagement therewith. Preferably, the movement of the detent device is produced automatically in the course of the relative approaching movements of the cleaning device and the reservoir, hence obviating the need for any direct manual operation of the detent device.

For demounting the reservoir, the locked condition of the reservoir can be canceled by displacing or rotating the detent device, which subsequently enables the reservoir to be detached from the cleaning device. In an advantageous development, the locked condition of the reservoir is canceled by actuating a release element.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
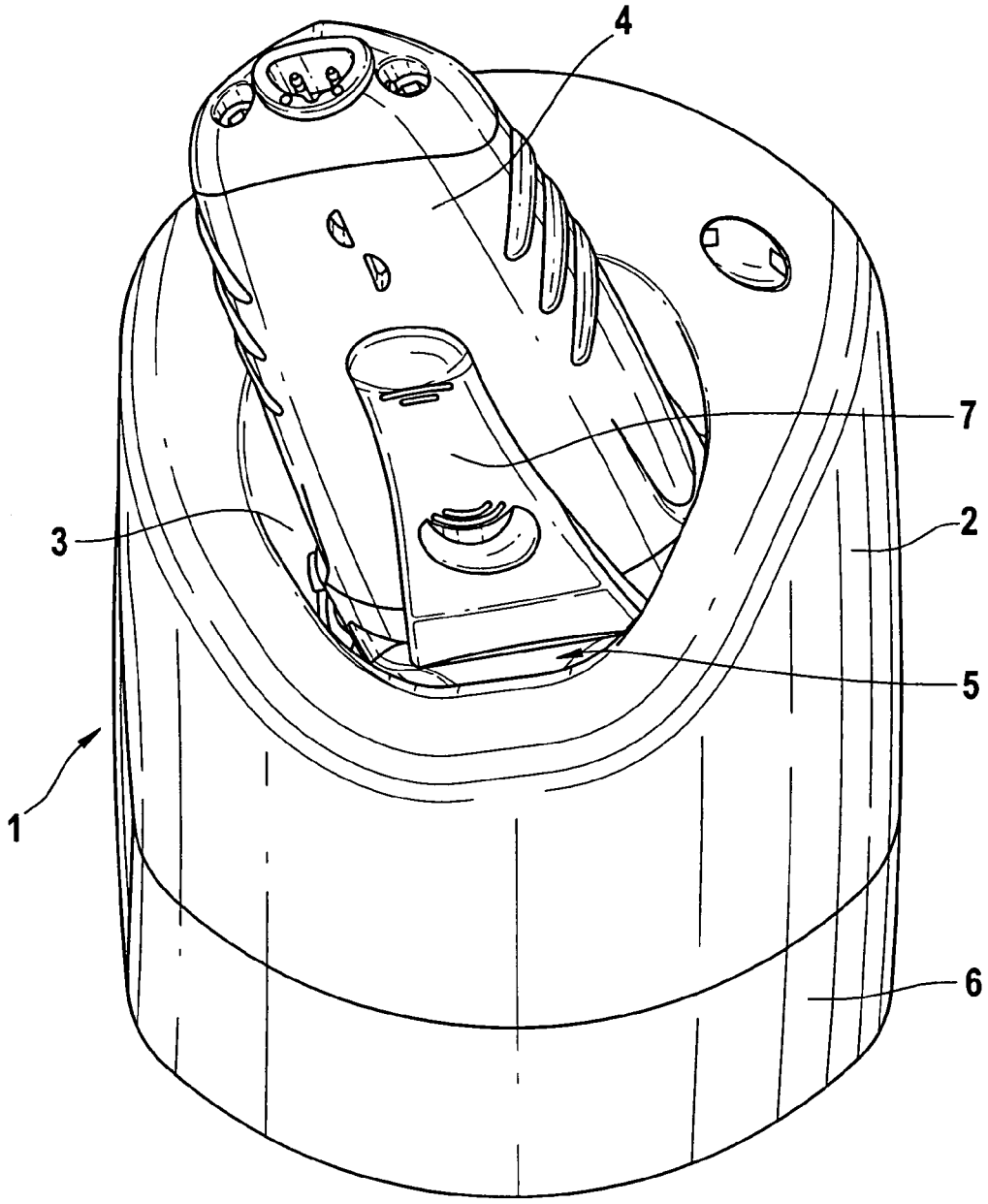
FIG. 1 is a perspective view of a cleaning device for a shaving apparatus showing the shaving apparatus seated therein.

FIG. 1 shows a cleaning device 1 in a perspective view. The cleaning device 1 includes an upper part 2 having a well 3 integrally formed therein. The shaving head 5 portion of an electric shaving apparatus 4 is received within the well 3. FIG. 1 also shows a cartridge cover 6 arranged underneath the upper part 2. The cover 6 will be explained in more detail in the following discussion.

To clean the shaving apparatus 4, a cleaning liquid is conveyed to the well 3 to flush the shaving head 5 of the shaving apparatus 4. In order to accomplish a particularly thorough cleaning operation, the shaving apparatus 4 is set in operation temporarily during the cleaning process. This can be performed in a variety of ways. For example, the shaving apparatus 4 can be turned on manually by means of a switch 7 that is also used for turning the shaving apparatus 4 on for a shave. The shaving apparatus 4 is subsequently turned off again after a desired period. However, those skilled in the art will recognize that the shaving apparatus 4 can also be actuated automatically. For example, a shaving apparatus 4 could also include a cleaning button (not shown) on the shaving apparatus 4 for activating a cleaning program under which the shaving apparatus 4 is set in operation automatically for one or more periods of time upon manual actuation of the cleaning button. Between the periods of operation, provision could be made for a soaking period. In a further modification, the shaving apparatus 4 could be equipped with electric contacts (not shown) for activating the cleaning program. The cleaning program could be started automatically when the cleaning device touches these contacts as the shaving head 5 is immersed in the well 3. The cleaning program can be held in memory in the shaving apparatus 4 so that the cleaning device 1 incurs no additional expenditure. However, it is also possible for the cleaning program to be stored in the cleaning device 1 and for the shaving apparatus 4 to be controlled through the electric contacts (not shown) in accordance with the cleaning program. Furthermore, the electric contacts (not shown) can be used for supplying a charging current to a shaving apparatus 4 powered by a rechargeable battery. Depending on the construction of the cleaning device 1, either a liquid current is caused to circulate around the shaving head 5 of the shaving apparatus 4 during the cleaning process, or the shaving head is immersed in the cleaning liquid held in the well 3 rather statically. The well 3 is evacuated subsequent to the cleaning operation.

Figure 2:
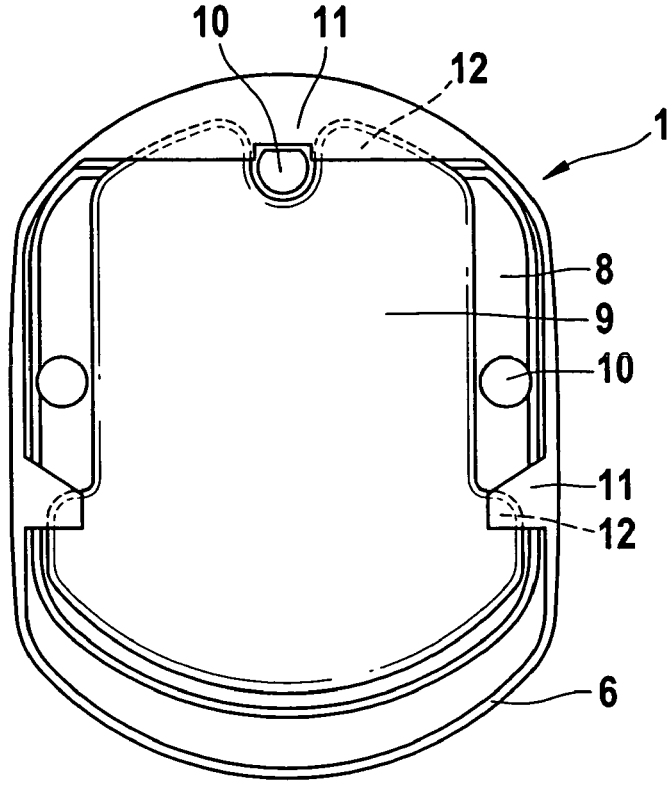
FIG. 2 is a bottom view of the cleaning device shown in FIG. 1.
Figure 3:
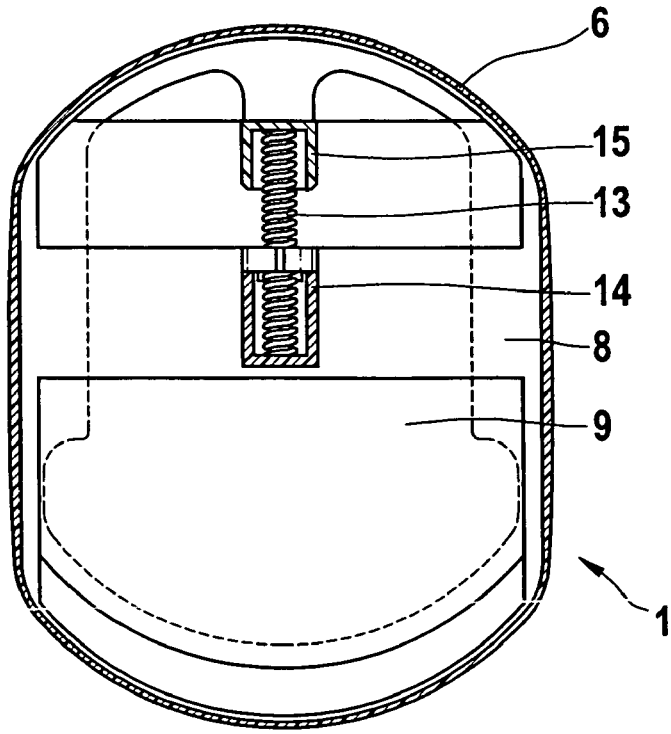
FIG. 3 is a schematic sectional view of the cleaning device shown in FIG. 1.
Figure 4:
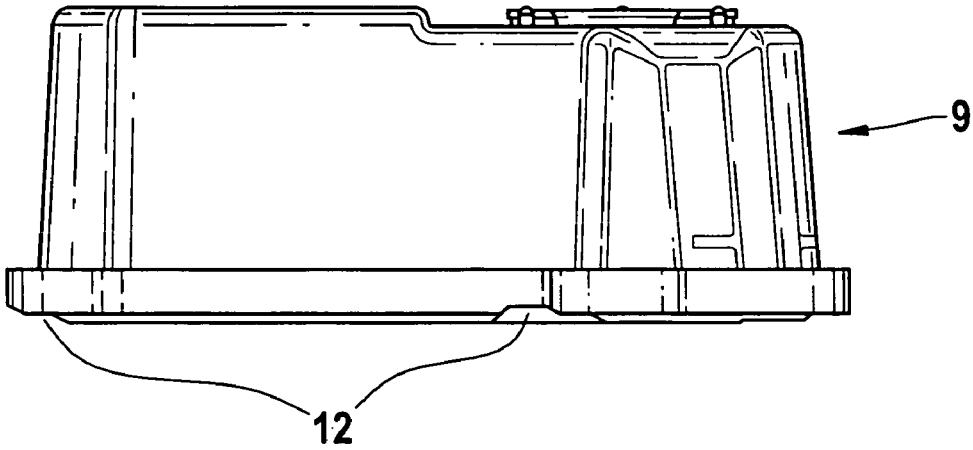
FIG. 4 is a side view of a cartridge for use in association with the cleaning device shown in FIG. 1.

FIG. 2 is a view of the underside of the cleaning device 1 embodied in FIG. 1, and FIG. 3 is a schematic sectional view in which components not needed for explanation are omitted for the sake of greater clarity of the illustration. The cartridge cover 6 is displaceably suspended on a chassis 8, with the direction of movement being parallel to the plane of projection and parallel to the longitudinal axis of the cleaning device 1 in the representation of FIGS. 2 and 3. Received within the cartridge cover 6 is a replaceable cartridge 9 holding a supply of cleaning liquid. With the cleaning device 1 placed down, the cartridge 9 sits on the depository (not shown) and carries the chassis 8 on which the upper part 2 takes support. Studs 10 formed on the chassis 8 secure the cartridge 9 against lateral displacement, i.e., against displacement parallel to the plane of projection, by positive engagement. In addition, the cartridge 9 is secured in a direction perpendicular to the plane of projection by positive engagement with the laterally inwardly extending projections 11 on the cartridge cover 6. Thus, the projections 11 hold the cartridge 9 captive when the cleaning device 1 is lifted clear of its depository (not shown). To this effect, the projections 11 engage into suitable recesses 12 provided on the bottom of the cartridge 9. FIG. 4 shows details of the geometry of the recesses 12.

As shown in FIG. 3, the cleaning device 1 also includes a compression spring 13 secured longitudinally between the cartridge cover 6 and the chassis 8. To this end, a first guide 14 receiving one end of the compression spring 13 is arranged on the cartridge cover 6. Opposite the first guide 14, a second guide 15, arranged on the chassis 8, receives the other end of the compression spring 13. The guides 14 and 15 are oriented in such manner that the compression spring 13 is held in tension parallel to the longitudinal side of the cleaning device 1. In consequence, the cartridge cover 6 is displaced by the action of the compression spring 13 in such manner that the projections 11 of the cartridge cover 6 are urged into the recesses 12 in the cartridge 9. This means that, when cartridge 9 is inserted, the compression spring 13 fixes cartridge 9 in place in the cartridge cover 6 of the cleaning device 1.Thus, the positive-engagement relationship between the cartridge cover 6 and the cartridge 9 can be canceled only by overcoming the restoring force of the compression spring 13.

In order to remove the cartridge 9 from the cleaning device 1, it is hence necessary for the cartridge cover 6 to be displaced longitudinally in opposition to the restoring force of the compression spring 13, so that the projections 11 of the cartridge cover 6 are disengaged from the recesses 12 in the cartridge 9. With the cartridge cover 6 in this position, the cleaning device 1 can be lifted off cartridge 9. Installing the cartridge 9 in the cleaning device 1 is an even simpler procedure. The cleaning device 1 is fitted over the cartridge 9 so that the projections 11 of the cartridge cover 6 snap into the recesses 12 in the cartridge 9, locking the cartridge 9 in the process. More specifically, the operation of installing the cartridge 9 in the cleaning device 1 proceeds as follows:

The cartridge 9 is located centrally in the cleaning device 1 by the studs 10 while the cleaning device 1 is lowered down onto the cartridge 9. At the same time, the cartridge cover 6 is displaced longitudinally relative to the chassis 8 due to contact with the cartridge 9 so as to compress the compression spring 13. As soon as the cleaning device 1 is lowered down on the cartridge 9 completely, contact between the cartridge cover 6 and the cartridge 9 is broken on account of their shape, and the cartridge cover 6, acted upon by the compression spring 13, is displaced longitudinally so that the projections 11 on the cartridge cover 6 enter the recesses 12 of the cartridge 9, locking the cartridge 9. As shown on FIG. 4 in detail, all of the recesses 12 of the cartridge 9 are open towards the same side so that all of the projections 11 of the cartridge cover 6 can be introduced into the recesses 12 in a joint movement.

FIG. 4 shows a cartridge 9 in a side view. The recesses 12 are formed in the sidewall of the cartridge 9 at several locations in the bottom area. Shape and dimensions of the recesses 12 are selected so as to enable the projections 11 of the cartridge cover 6 to be pushed under the cartridge 9 in the area of the recesses 12. To prevent the projections 11 of the cartridge cover 6 from touching the depository (not shown) on which the cleaning device 1 sits, the recesses 12 are somewhat deeper than the corresponding dimensions of the projections 11.

Figure 5:
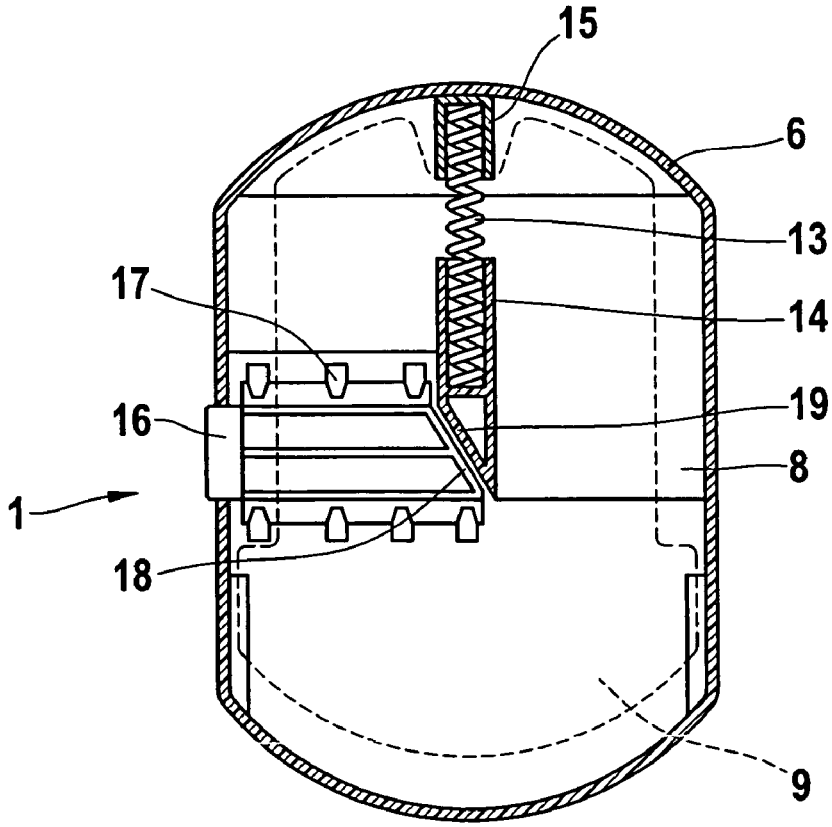
FIG. 5 is a schematic sectional view of a cleaning device with an unlocking mechanism.

FIG. 5 shows an embodiment of the cleaning device 1 in a schematic sectional view. This embodiment includes an unlocking mechanism to facilitate the removal of the cartridge 9. The unlocking mechanism has a manually operable release slide 16 protruding laterally from the cleaning device 1 and guided between two parallel rows of guide elements 17 attached to the chassis 8. The guide elements 17 are arranged so as to enable the release slide 16 to be displaceable in a direction transverse to the direction of movement of the cartridge cover 6. At its end situated within the cleaning device 1, the release slide 16 has an end face 18. End face 18 extends at an inclination to its direction of movement and cooperates with an incline 19. Incline 19 is arranged in the proximity of the first guide 14 for the compression spring 13 and is fixedly connected with the cartridge cover 6. The release slide 16 is actuated by manual pressure exerted on its outwardly extending end. This causes the release slide 16 to be pushed deeper into the interior of the cleaning device 1. Owing to the cooperative relationship between the end face 18 of the release slide 16 and the incline 19, this motion is deflected by 90°, hence causing the cartridge cover 6 to be displaced while the restoring force of the compression spring 13 is overcome. This withdraws the projections 11 of the cartridge cover 6 from their recesses 12 in the cartridge 9, thus unlocking cartridge 9. With continued actuation of the release slide 16, the cleaning device 1 is lifted clear of the cartridge 9. The cartridge 9 can be installed in the cleaning device 1 selectively with or without actuation of the release slide 16.

Figure 6:
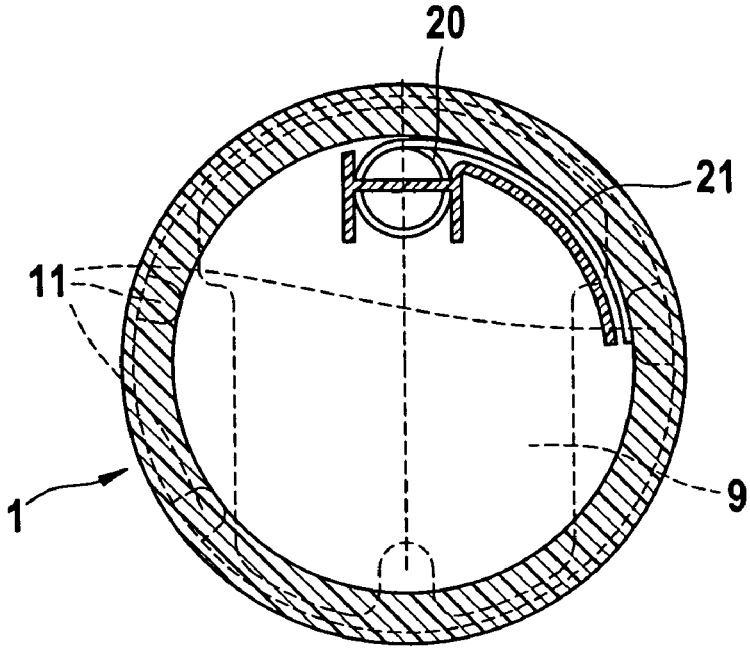
FIG. 6 is a schematic sectional view of a cleaning device with a rotatable cartridge cover.
Figure 7:
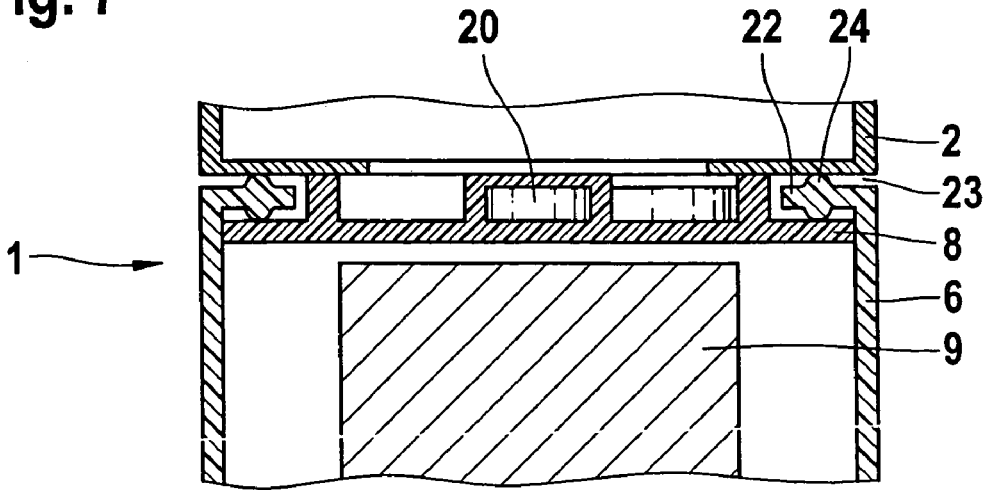
FIG. 7 is another sectional view of the cleaning device shown in FIG. 6.

FIG. 6 shows an embodiment of the cleaning device 1 in a schematic sectional view. Another sectional view with a section plane extending perpendicular thereto is illustrated in FIG. 7. In this embodiment, the cartridge cover 6 is rotated, rather than being deflected in a translational motion, to lock the cartridge 9 in the cleaning device 1. To accomplish this, the cartridge cover 6 has a circular cross section and is rotatably suspended on the chassis 8. Using, for example, a coiled-strip spring 20, the cartridge cover 6 is biased toward a rotary position in which the projections 11 of the cartridge cover 6 engage within the recesses 12 in the cartridge 9, thereby locking the cartridge 9 in the cleaning device 1. The coiled-strip spring 20 is attached to the chassis 8 and includes a spring strip 21 having its free end connected with the cartridge cover 6. In the representation of FIG. 6, the cartridge cover 6 is rotated clockwise relative to the chassis 8 so that the operation of placing the cleaning device 1 over the cartridge 9 is not impeded by the projections 11 of the cartridge cover 6.

As shown in FIG. 7, the rotatable suspension of the cartridge cover 6 on the chassis 8 can be implemented by providing the cartridge cover 6 with a radially inwardly directed flange 22 in the region of its upper edge, the flange 22 engaging in an annular gap 23. The annular gap 23 is formed by the chassis 8 and the upper part 2 secured thereon. To ensure ease of rotary movement of the cartridge cover 6, a circumferential annular elevation 24 is formed on the upper side and the underside of the flange 22.

Similar to the first and second embodiment, in the third embodiment loading the cartridge 9 involves placing the cleaning device 1 over the cartridge 9. However, the cartridge cover 6 is not displaced in the process, but is rotated to assume the rotary position illustrated in FIG. 6. As soon as the cartridge 9 is completely inserted in the cleaning device 1, the cartridge cover 6, driven by the restoring force of the coiled-strip spring 20, rotates back again such an amount that the projections 11 of the cartridge cover 6 engage into the recesses 12 in the cartridge 9, thereby locking the cartridge 9 in the cleaning device 1.

To remove the cartridge 9, the cartridge cover 6 is rotated while overcoming the restoring force of the coiled-strip spring 20 until the rotary position illustrated in FIG. 6 is reached. In this rotary position, the cleaning device 1 is lifted clear of the cartridge 9.

A number of embodiments have been described. Nevertheless, it will be understood that various modifications may be made without departing from the spirit and scope of the invention. For example, a viewing window may be embedded in the cartridge cover 6. Such a viewing window would enable the presence or absence of a cartridge 9 in the cleaning device 1 to be established. It is furthermore possible to read the level of the cleaning liquid in the cartridge 9 loaded in the cleaning device 1, provided the cartridge is sufficiently transparent or is likewise equipped with a viewing window at a corresponding location. Accordingly, other embodiments are within the scope of the following claims.

What is claimed is:

1. A cleaning device for a shaving head portion of a shaving apparatus comprising:

a cleaning container for receiving the shaving head portion of the shaving apparatus;

a chassis supporting the cleaning container;

a resilient element; and a detent device movably suspended on the chassis wherein the resilient element biases the detent device toward a first position in which the detent device fixedly secures a replaceable reservoir holding a supply of cleaning liquid to the chassis in a positive engagement relationship therewith.

2. The cleaning device of claim 1, wherein the detent device fixedly secures the reservoir in a mounting direction provided for replacement of the reservoir.

3. The cleaning device of claim 2, wherein the securing of the reservoir by positive engagement in a direction transverse to the mounting direction of the reservoir is accomplished with the chassis.

4. The cleaning device of claim 3, wherein the resilient element comprises a compression spring.

5. The cleaning device of claim 4, wherein the detent device makes positive engagement with the reservoir in the region of the bottom of the reservoir.

6. The cleaning device of claim 4, wherein the detent device is configured as a housing part encompassing the reservoir.

7. The cleaning device of claim 4, wherein the reservoir supports the chassis.

8. The cleaning device of claim 2, wherein the securing of the reservoir by positive engagement in a direction transverse to the mounting direction of the reservoir is accomplished with components fixedly connected with the chassis.

9. The cleaning device of claims 2, wherein the detent device is suspended on the chassis so as to be movable in a direction transverse to the mounting direction of the reservoir.

10. The cleaning device of claim 9, further comprising a release element for moving the detent device, by overcoming the restoring force of the resilient element, in the direction of a second position in which the detent device releases the reservoir.

11. The cleaning device of claim 10, wherein the release element is movable in a direction transverse to the direction of movement of the detent device.

12. The cleaning device of claim 11, wherein die detent device makes positive engagement with the reservoir in the region of the bottom of the reservoir.

13. The cleaning device of claim 11, wherein the detent device is configured as a housing part encompassing the reservoir.

14. The cleaning device of claim 11, wherein the reservoir supports the chassis.

15. The cleaning device of claim 2, wherein the detent device is rotatably suspended on the chassis.

16. The cleaning device of claim 15, wherein the resilient element comprises a coiled strip spring.

17. The cleaning device of claim 16, wherein the detent device makes positive engagement with the reservoir in the region of the bottom of the reservoir.

18. The cleaning device of claim 16, wherein the detent device is configured as a housing part encompassing the reservoir.

19. The cleaning device if claim 16, wherein the reservoir supports the chassis.

20. A cleaning device for a shaving head portion of a shaving apparatus comprising:

a cleaning container for receiving the shaving head portion of the shaving apparatus;

a chassis supporting the cleaning container;

a resilient element comprising a compression spring;

a detent device configured as a housing part encompassing a replaceable reservoir holding a supply of cleaning liquid; the detent device movably suspended on the chassis wherein the resilient element biases the detent device toward a first position in which the detent device fixedly secures the replaceable reservoir to the chassis in a mounting direction provided for replace rent of the reservoir; rite detent device making positive engagement with the reservoir the region of the bottom of the reservoir, the positive engagement in a direction transverse to the mounting direction of the reservoir is accomplished with the chassis; and a release element for moving the detent device, by overcoming the restoring force of the resilient element, in the direction of a second position in which the detent device releases the reservoir; the release element movable in a direction transverse to the direction of movement of the detent device.

21. A cleaning device for a shaving head portion of a shaving apparatus comprising:

a cleaning container for receiving the shaving head portion of the shaving apparatus;

a chassis supporting the cleaning container;

a resilient element comprising a coiled strip spring;

a detent device configured as a housing part encompassing a replaceable reservoir holding a supply of cleaning liquid; the detent device rotatably suspended on the chassis wherein the resilient element biases the detent device toward a first position in which the detent device fixedly secures replaceable reservoir to the chassis in a mounting direction provided for replacement of the reservoir; the detent device making positive engagement with the reservoir in the region of the bottom of the reservoir, the positive engagement in a direction transverse to the mounting direction of the reservoir is accomplished with the chassis; and a release element for moving the detent device, by overcoming the restoring force of the resilient element, in the direction of a second position in which the detent device releases the reservoir; the release element movable in a direction transverse to the direction of movement of the detent device.

22. A system comprised of:

a shaving apparatus that includes an actuating device for activating a cleaning function that sets the shaving apparatus in operation temporarily during cleaning; and a cleaning device for cleaning the apparatus, the cleaning device comprising;

a cleaning container for receiving the shaving head portion of the shaving apparatus;

a chassis supporting the cleaning container;

a resilient element; and a detent device movably suspended on the chassis wherein the resilient element biases the detent device toward a first position in which the detent device fixedly secures a replaceable reservoir holding a supply of cleaning liquid to the chassis in a positive engagement relationship therewith.

23. The system of claim 22, wherein the actuating device is operable manually.

24. The system of claim 22, wherein the actuating device is operable by the cleaning device.

* * * * *

UNITED STATES PATENT AND TRADEMARK OFFICE

CERTIFICATE OF CORRECTION

PATENT NO. : 7,107,692 B2
APPLICATION NO. : 10/815322
DATED : September 19, 2006
INVENTOR(S) : Diana Kappes, Andreas Larscheid and Uwe Ludascher It is certified that error appears in the above-identified patent and that said Letters Patent is hereby corrected as shown below:

Column 7, Claim 12, Line 62:
Delete “die” Insert --the--

Column 8, Claim 20, Line 27:
Delete “replace rent” Insert --replacement--

Column 8, Claim 20, Line 28:
Delete “rite” Insert --the--

Column 8, Claim 20, Line 29:
After “reservoir” Insert --in--

Column 9, Claim 22, Line 1:
Insert --shaving-- between “the” and “apparatus”

Signed and Sealed this

Fourth Day of September, 2007

JON W. DUDAS
*Director of the United States Patent and Trademark Office*